US011519223B2

(12) United States Patent
Elnore

(10) Patent No.: US 11,519,223 B2
(45) Date of Patent: Dec. 6, 2022

(54) WHEELED CLIMBING SYSTEM

(71) Applicant: Moustafa M. Elnore, Linden, NJ (US)

(72) Inventor: Moustafa M. Elnore, Linden, NJ (US)

( * ) Notice: Subject to any disclaimer, the term of this patent is extended or adjusted under 35 U.S.C. 154(b) by 0 days.

(21) Appl. No.: 15/052,162

(22) Filed: Feb. 24, 2016

(65) Prior Publication Data

US 2017/0241203 A1 Aug. 24, 2017

(51) Int. Cl.
*E06C 1/397* (2006.01)
*E06C 1/14* (2006.01)
*E06C 1/24* (2006.01)

(52) U.S. Cl.
CPC ..... *E06C 1/397* (2013.01); *E06C 1/14* (2013.01); *E06C 1/24* (2013.01)

(58) Field of Classification Search
CPC ... E06C 1/397; E06C 1/14; E06C 1/24; E06C 7/143; E06C 2001/242
See application file for complete search history.

(56) References Cited

U.S. PATENT DOCUMENTS 3,865,203 A * 2/1975 Hibma ..... E04G 1/28 180/443
4,967,733 A * 11/1990 Rousseau ..... B66F 11/04 182/69.6
5,653,305 A * 8/1997 Duke ..... E06C 1/393 182/174
8,593,265 B1 * 11/2013 Dornfeld ..... G08C 17/00 182/127
2001/0047905 A1 * 12/2001 Boyer ..... E06C 1/397 182/15
2004/0245045 A1 12/2004 Shai
2005/0034923 A1 2/2005 Feik et al.
2007/0114742 A1 * 5/2007 Gilbert ..... E06C 5/02 280/79.11

* cited by examiner

*Primary Examiner* — Daniel P Cahn
*Assistant Examiner* — Shiref M Mekhaeil
(74) *Attorney, Agent, or Firm* — Rahman LLC

(57) ABSTRACT

A moveable climbing system includes at least one step, a first set of legs, a second set of legs, a first set of wheels operatively connected to the first set of legs, a second set of wheels operatively connected to the second set of legs, and a motor operatively connected to the first set of wheels, configured to rotate the first set of wheels. The climbing system may further include a battery for providing electric supply for the motor. The at least one step may include a rung of a ladder. The at least one step may include a board of a scaffold. The climbing system may further include a motor box housing the electric motor, wherein the motor box may be configured to operatively connect to and disconnect from the at least one step.

8 Claims, 17 Drawing Sheets

A - A

WHEELED CLIMBING SYSTEM

BACKGROUND

Technical Field

The embodiments herein generally relate to climbing systems, and more particularly to ladders and scaffolding systems.

Description of the Related Art

Equipment such as ladders or scaffolds allow for the performance of tasks at heights not normally reachable by a worker. However, when using conventional ladders or scaffolds, the worker's horizontal reach is generally limited to the worker's arms' span. In order to reach a further distance, the worker may need to stop work and relocate the ladder. For example, when installing weirs or pipes at high places using a conventional ladder, workers may need to periodically stop work. Alternatively, workers may require assistance of others or may need to use other expensive tools to do the required job. It would be desirable to use systems that allow for extending the reach of the worker while on top of a ladder or a scaffold.

SUMMARY

In view of the foregoing, an embodiment herein provides a moving ladder system comprising: a ladder, a first set of legs, a second set of legs, a first set of wheels configured to operatively connect to the first set of legs, a second set of wheels configured to operatively connect to the second set of legs, a movement mechanism configured to rotate the first set of wheels, and a steering mechanism configured to steer the second set of wheels.

The movement mechanism may comprise an electric motor operatively connected to the first set of wheels. The ladder system may further comprise a motor box housing the electric motor, wherein the motor box is configured to operatively connect to and disconnect from the ladder. The first set of wheels and the second set of wheels may be configured to disconnect from the first set of legs and the second set of legs respectively. The first set of wheels and the second the of wheels, when disconnected from the first set of legs and the second set of legs respectively, may be configured to operatively connect to and disconnect from the motor box, when the motor box is disconnected from the ladder. The motor box may be configured to move using the first set of wheels and the second set of wheels, when the motor box is detached from the ladder, and when the first set of wheels and the second set of wheels are operatively connected to the motor box.

The ladder system may further comprise a remote controller configured to remotely control movement of the motor box. The remote controller may comprise a wireless joystick, and the motor box may comprise a wireless receiver configured to receive control signals for remotely controlling movement of the motor box. The motor may comprise a brake. The steering mechanism may comprise a joystick configured to send steering signals to the motor. The joystick may send the steering signals to the motor wirelessly.

Another embodiment provides a moveable climbing system comprising: at least one step, a first set of legs, a second set of legs, a first set of wheels operatively connected to the first set of legs, a second set of wheels operatively connected to the second set of legs, and a motor operatively connected to the first set of wheels, configured to rotate the first set of wheels. The climbing system may further comprise a battery for providing electric supply for the motor. The at least one step may comprise a rung of a ladder. The at least one step may comprise a board of a scaffold. The climbing system may further comprise a motor box housing the electric motor, wherein the motor box may be configured to operatively connect to and disconnect from the at least one step.

Another embodiment provides a moving climbing system comprising: at least one step, a first set of legs, a second set of legs, a first set of wheels operatively connected to the first set of legs, a second set of wheels operatively connected to the second set of legs, a first handle operatively connected to the first set of wheels by a first shaft and an axle, wherein the first handle is configured to steer the first set of wheels, and a second handle operatively connected to the second set of wheels by a second shaft, wherein the second handle is configured to rotate the second set of wheels. The first shaft may be operatively connected to a climax, and the climax may be configured to operate as a brake for the first set of wheels when the first handle is pushed down. The at least one step may comprise a rung of a ladder. The at least one step may comprise a board of a scaffold.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The embodiments herein will be better understood from the following detailed description with reference to the drawings, in which.

DETAILED DESCRIPTION

Figure 1:
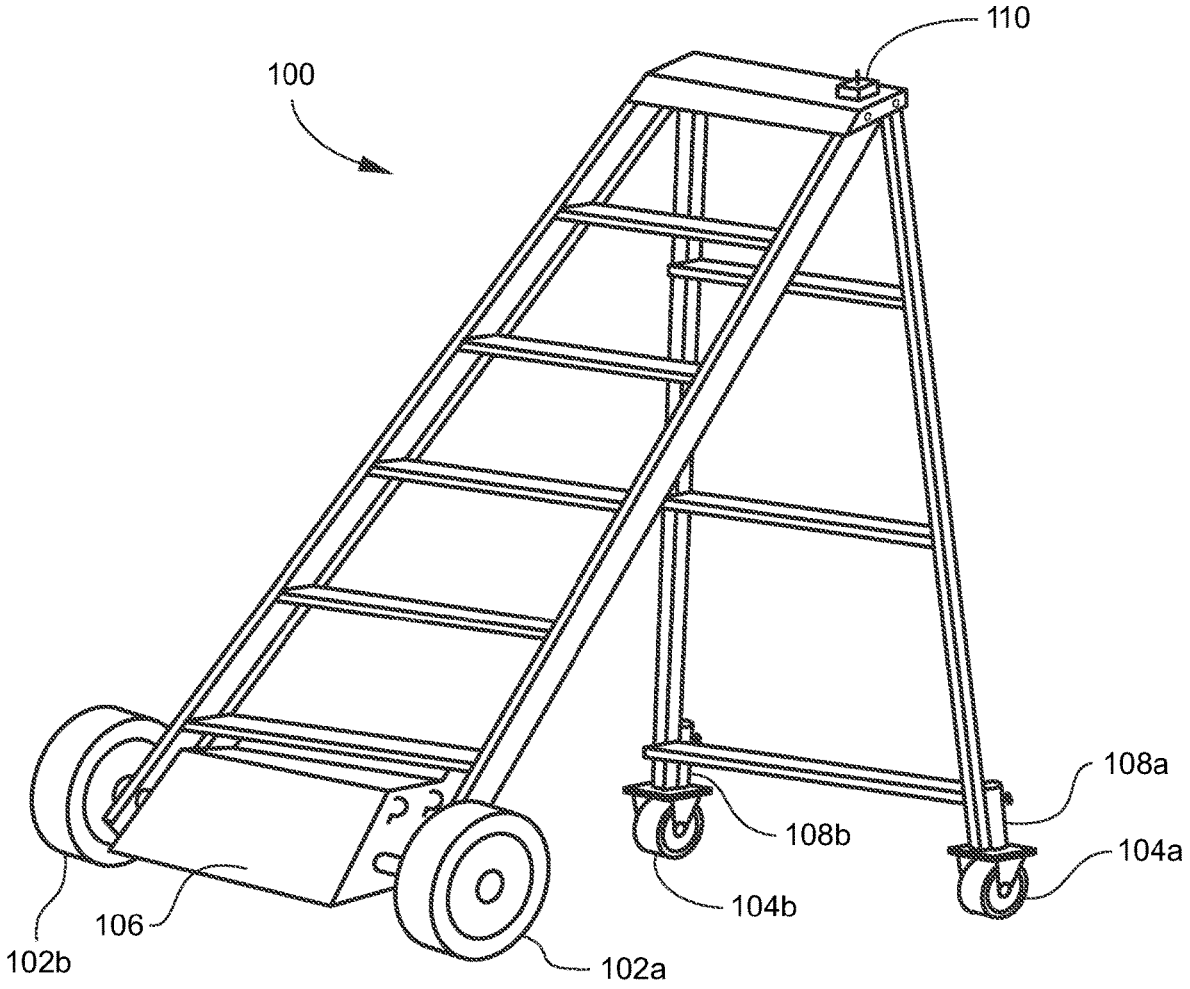
FIG. 1 is a schematic diagram illustrating a ladder according to an embodiment herein.

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

The embodiments herein generally relate to systems and methods for a user of a ladder or a scaffold to move around without stepping down and relocating the ladder or scaffold. In embodiments, the ladder may be any type of manual or powered move-on ladder or scaffold. The embodiments herein are not limited to any particular design, shape, or size of the ladder or scaffold. In one embodiment, the ladder is an "A" frame step ladder. Embodiments herein save production time by adding wheels to the ladder and controlling the wheels manually or by an electric motor. Embodiments herein provide manual or power wheel ladder. The manual or power wheel ladder is much easier to use on a work site compared to conventional ladders. It is convenient and provides time savings to the worker because it safely keeps the worker on the ladder while relocating/moving. Referring now to the drawings, and more particularly to FIGS. 1 through 16, where similar reference characters denote corresponding features consistently throughout the figures, there are shown preferred embodiments.

FIG. 1 is a schematic diagram illustrating an "A" frame ladder 100 according to an embodiment herein. In an embodiment, the ladder 100 has a height in a range from approximately 6 feet to approximately 12 feet, although other heights could be used. The ladder 100 may include adjustable wheels 102*a* and 102*b*. The ladder 100 may include a motor box 106 connected to the wheels 102*a* and 102*b*. In an embodiment, each of the wheels 102*a* and 102*b* has an approximately 10-inch diameter, although other configurations and sizes are possible. The ladder 100 may include a joystick 110. In an embodiment, the joystick 110 is configured to control movement of the ladder 100. Joystick 110 may control the movement of the ladder 100 via wire connection, or wirelessly. In an embodiment, the joystick 110 may be detached from the ladder 100 and configured to control the movement of the ladder 100 wirelessly and remotely.

Ladder 100 may include free wheels 104*a* and 104*b*. In an embodiment, each of the wheels 104*a* and 104*b* has an approximately 4-inch diameter, although other configurations and sizes are possible. In an embodiment, the ladder 100 includes pipes 108*a* and 108*b*. In an embodiment, the pipes 108*a* and 108*b* are connected to the wheels 104*a* and 104*b*. In an embodiment, the pipes 108*a* and 108*b* are configured to connect the wheels 104*a* and 104*b* to the ladder 100. In an embodiment, each of the pipes 108*a* and 108*b* is approximately four inches long and has an approximately 1-inch diameter, although other configurations and sizes are possible.

Figure 2:
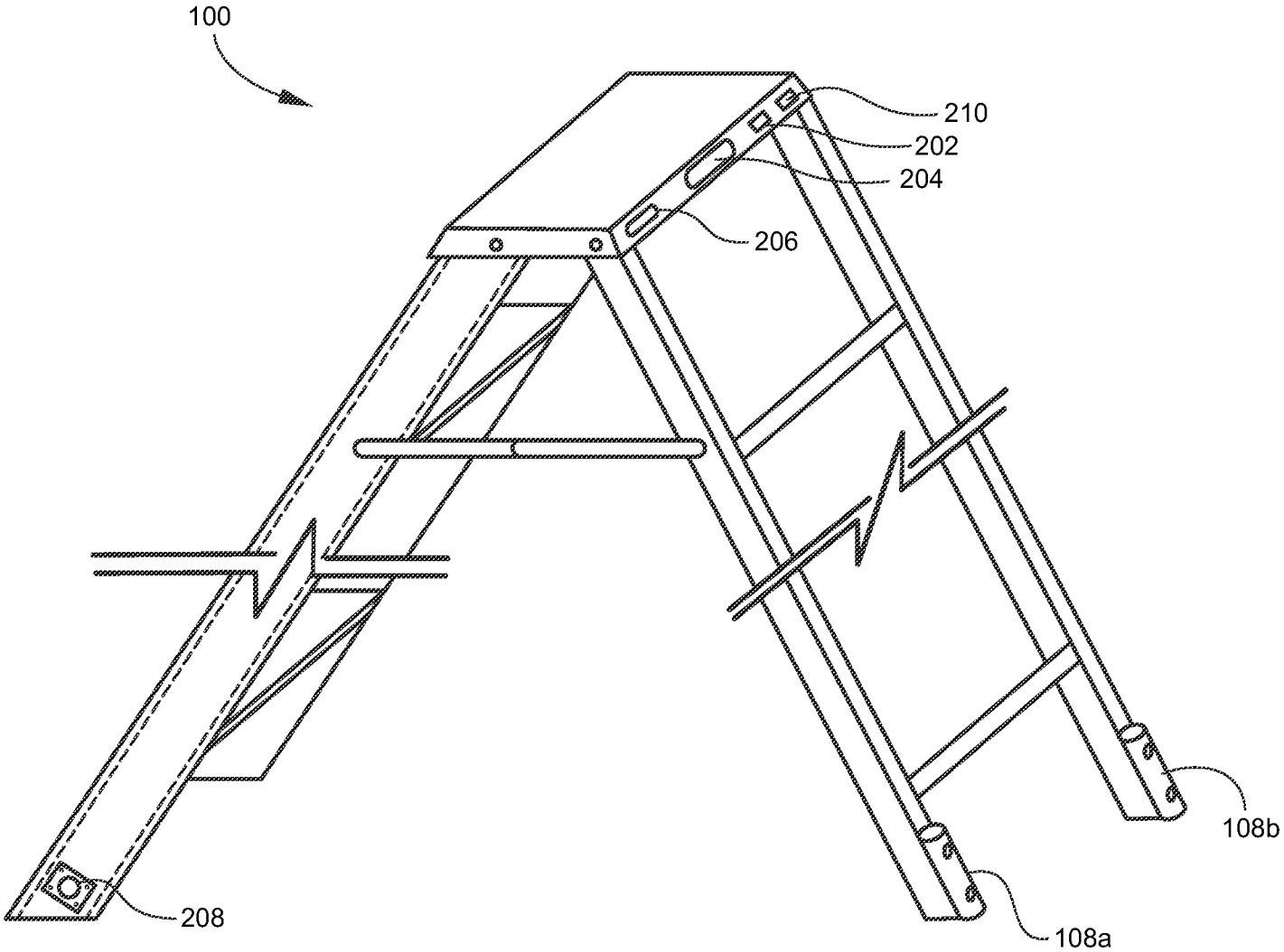
FIG. 2 is a schematic diagram illustrating another view of the ladder of FIG. 1 according to an embodiment herein.

FIG. 2, with reference to FIG. 1, is a schematic diagram illustrating a side view of the ladder 100 without the motor box 106, the wheels 102*a* and 102*b*, and the wheels 104*a* and 104*b*, according to an embodiment herein. The ladder 100 may include a light 204, and a light switch 202 for controlling the light 204. The ladder 100 may include an electric outlet 206 for connecting to the joystick 110. The ladder 100 may include an electric outlet 210 for powering electric tools used by a user of the ladder 100.

In an embodiment, the ladder 100 includes a flanged cast housing 208. The flanged cast housing 208 may include mounted bearings. In an embodiment the mounted bearings are approximately ⅝-inch bearings, although other configurations and sizes are possible. Moreover, other configurations of the ladder 100 could be utilized including leaning ladders such that the wheels 102*a* and 102*b* may be configured to provide for proper balancing when being moved/translated.

Figure 3A:
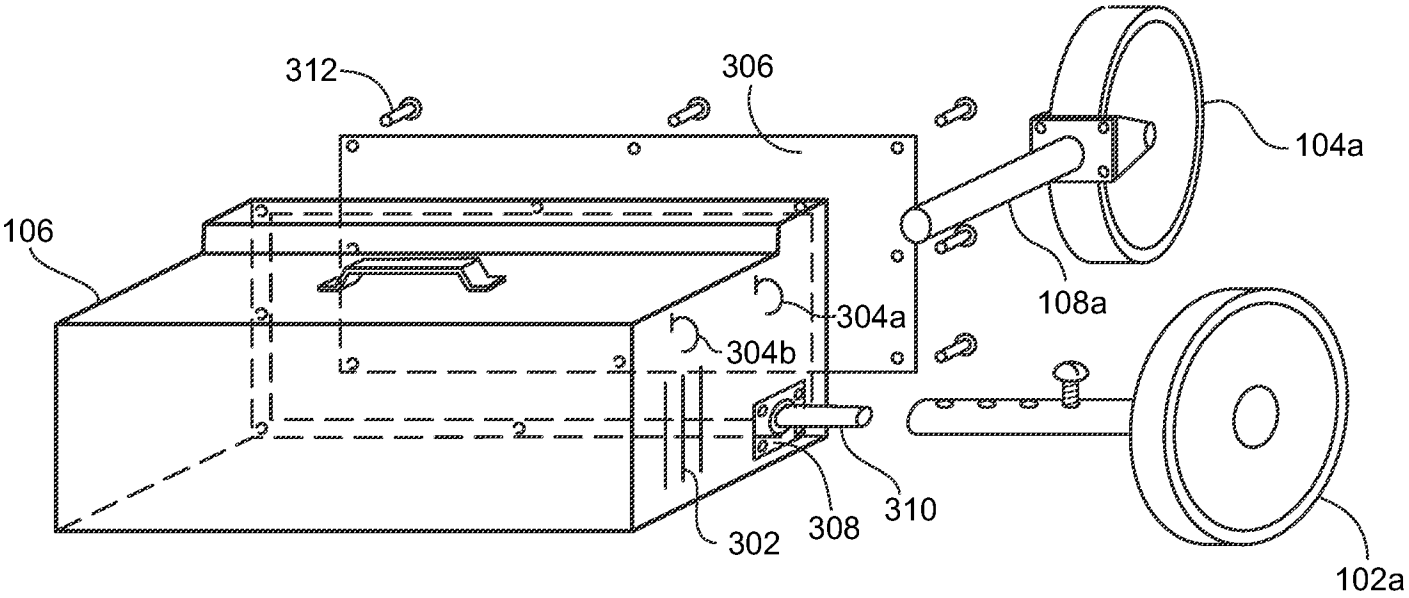
FIG. 3A is a schematic diagram illustrating a motor box according to an embodiment herein.

FIG. 3A, with reference to FIG. 1 and FIG. 2, is a schematic diagram illustrating the motor box 106 according to an embodiment herein. The motor box 106 may include a back panel 306. The back panel 306 may be configured to connect to the motor box 106 by screws 312 or other connection mechanisms. The motor box 106 may include air lines 302 configured to allow air circulation in the motor box 106.

In an embodiment a flanged cast housing 308 is configured to connect to the wheel 102*a* using a shaft 310. The flanged cast housing 308 may include mounted bearings. In an embodiment the mounted bearings are approximately ⅝-inch bearings, although other configurations and sizes are possible. A similar flanged cast housing on the opposite side of the motor box 106 (not shown) is configured to similarly connect to the wheel 102*b*. In an embodiment, hooks 304*a* and 304*b* are configured to attach to the pipe 108*a* and the wheel 104*a*. A similar pair of hooks on the opposite side of the motor box 106 may be configured to similarly attach to the pipe 108*b* and the wheel 104*b*.

Figure 3B:
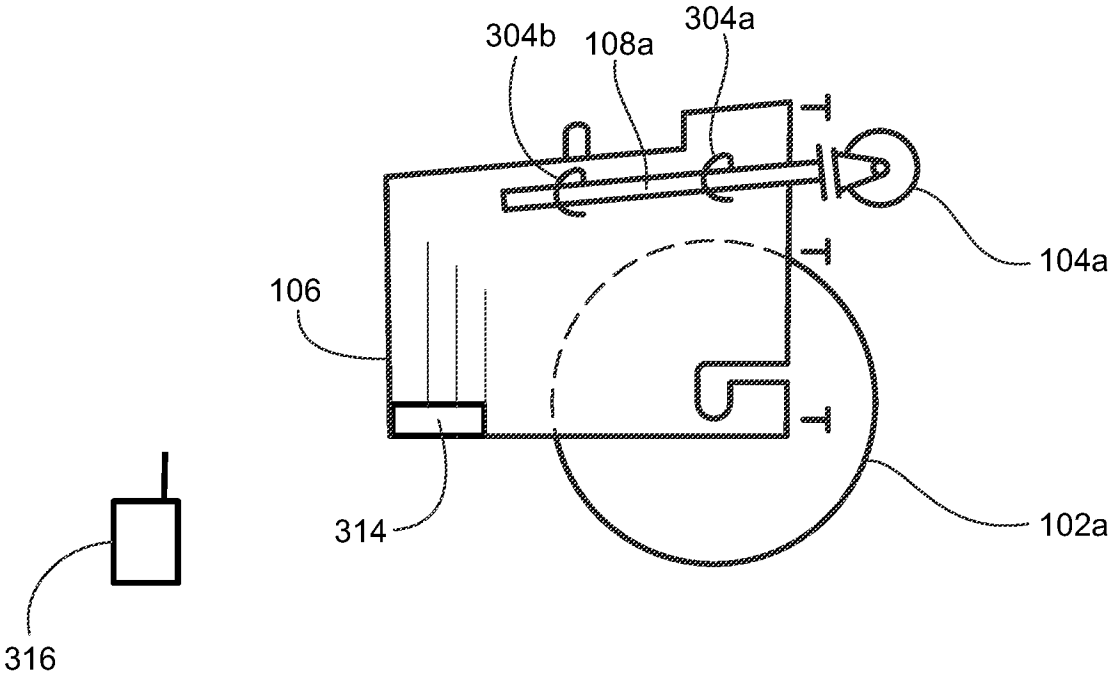
FIG. 3B is a schematic diagram illustrating another view of the motor box of FIG. 3A according to an embodiment herein.

FIG. 3B, with reference to FIGS. 1 through 3A, is a schematic diagram illustrating the motor box 106 according to an embodiment herein. In the exemplary embodiment of FIG. 3B, the wheels 102*a* and 102*b* are connected to the motor box 106, using the flanged cast housing 308 and the shaft 310, as illustrated in FIG. 3A. In the exemplary embodiment of FIG. 3B, the wheels 104*a* and 104*b* are connected to the motor box 106 using the pipes 108*a* and 108*b* and the hooks 304*a* and 304*b*. Using this embodiment, a worker may drive the motor box 106 from a vehicle to a construction site using the wheels 102*a* and 102*b* and 104*a* and 104*b*. The embodiments allow the worker to simply install the wheels 102*a* and 102*b* and 104*a* and 104*b* on the motor box 106 for driving the motor box to the proximity of the ladder 100 and then simply installing the motor box 106 and the wheels 102*a* and 102*b* and 104*a* and 104*b* on the ladder 100 as illustrated in FIGS. 1 and 2. In an embodiment, motor box 106 includes a wireless receiver 314. Movement of the motor box 106 may be controlled remotely using a wireless controller 316. In an embodiment, wireless controller 316 may be configured as a wireless joystick.

Figure 4:
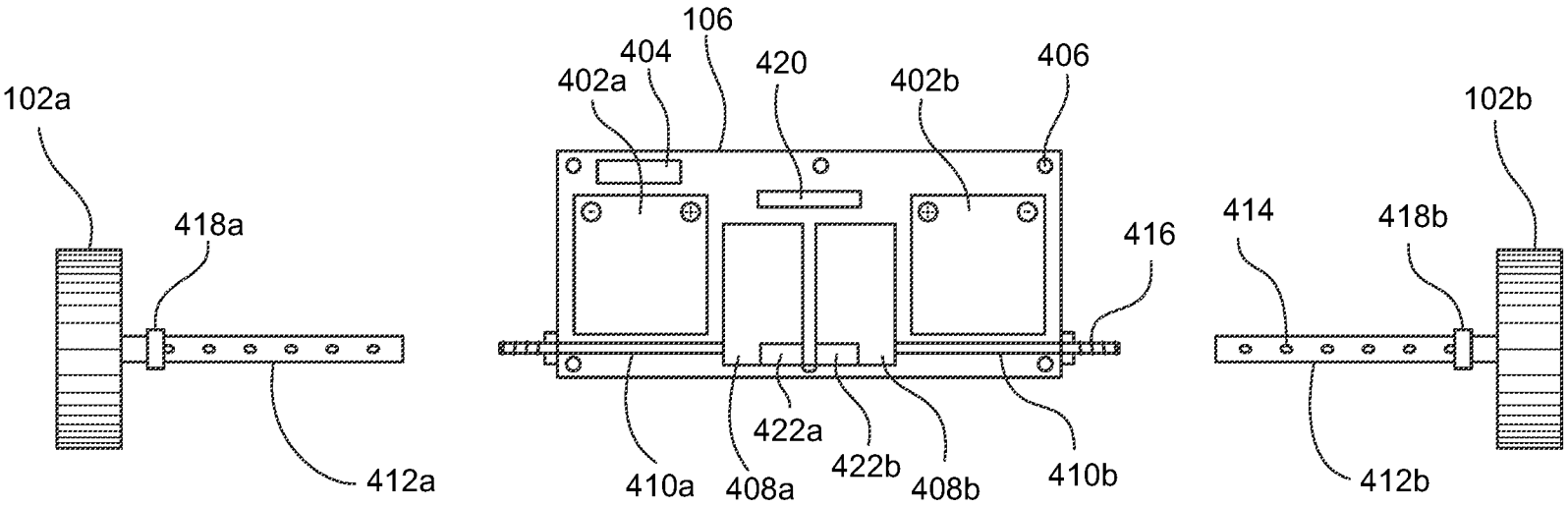
FIG. 4 is a schematic diagram illustrating a motor system according to an embodiment herein.

FIG. 4, with reference to FIGS. 1 through 3B, is a schematic diagram illustrating components of the motor box 106. In an embodiment, motor box 106 includes motors 408*a* and 408*b*, batteries 402*a* and 402*b*, a battery charger 404, a motor controller 420, and axles 410*a* and 410*b*. In an embodiment, the motors 408*a* and 408*b* may include brake systems 422*a* and 422*b* for safety. The axles 410*a* and 410*b*, may include pins 416. Pins 416 may be configured to fit pin holes 414 on female axles 412*a* and 412*b*, connected to the wheels 102*a* and 102*b* respectively. In an embodiment, climaxes 418*a* and 418*b*, are attached to the axles 412*a* and 412*b*, respectively.

In an embodiment, the axles 412*a* and 412*b* are longer than the axles 410*a* and 410*b* (e.g., two inches longer in one embodiment, although other configurations and sizes are possible). In an embodiment, each of the axles 410*a* and 410*b* has a diameter of ½ inch, although other configurations and sizes are possible. In an embodiment, the axels 412*a* and 412*b* are ⅝ inch in exterior diameter and ½ inch in interior diameter, although other configurations and sizes are possible. In an embodiment, each of the climaxes 418*a* and 418*b* are ⅝ inch in diameter, although other configurations and sizes are possible. In an embodiment, the motor box 106 is controlled using wired communication. As such, motor box 106 may include joy stick connector 406. In an embodiment, the motor box 106 may be controlled wirelessly. In such embodiment, motor box 106 may include wireless receiver 314 as described in FIG. 3B.

Figure 5:
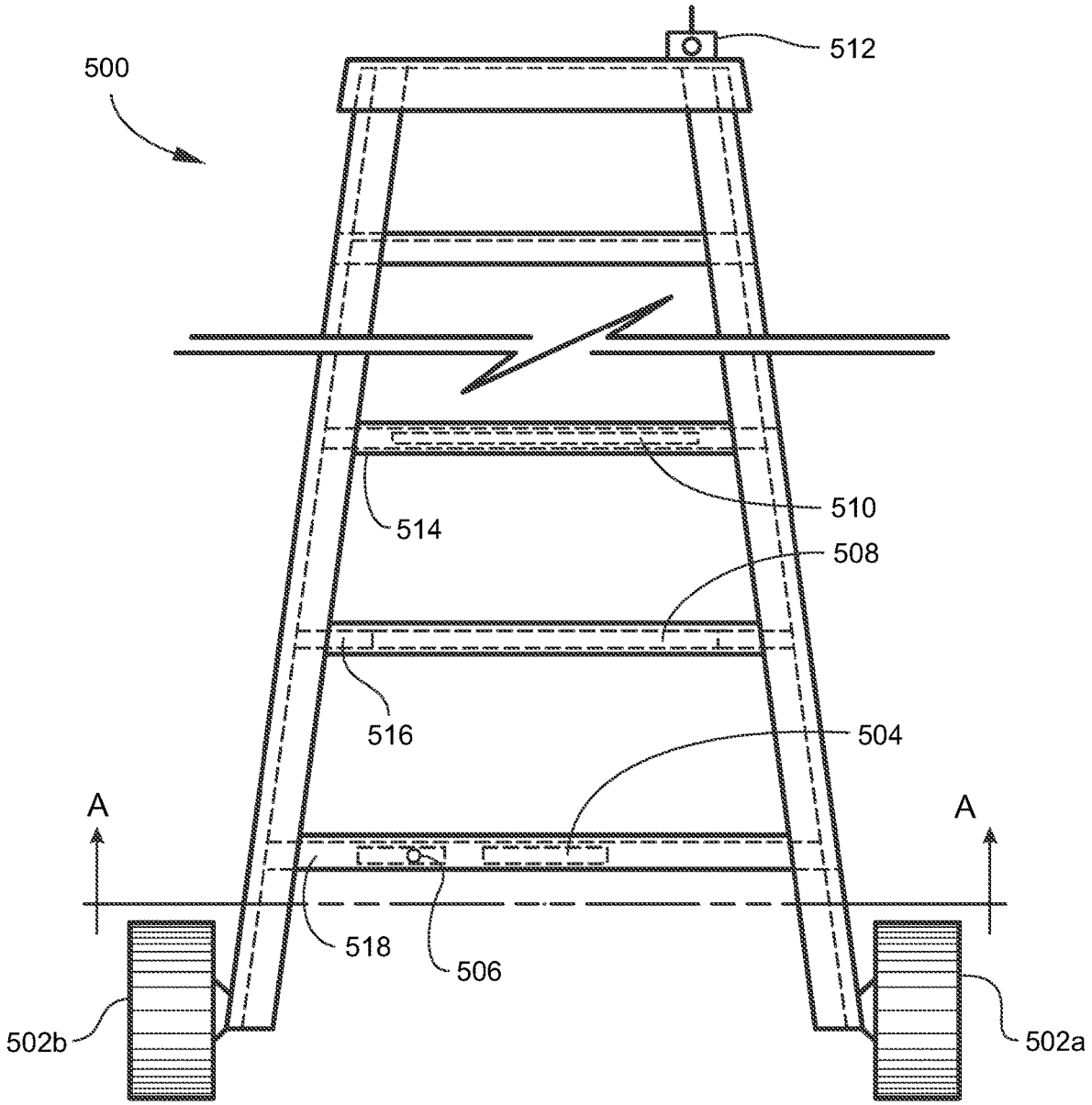
FIG. 5 is a schematic diagram illustrating a ladder according to another embodiment herein.

FIG. 5, with reference to FIGS. 1 through 4, is a schematic diagram illustrating a ladder 500, according to an embodiment herein. The ladder 500 may include fixed motor hub wheels 502*a* and 502*b*. The motor hub wheels 502*a* and 502*b* may include a brake system for safety. In an embodiment, ladder 500 may include batteries 508 and 510. In an embodiment, batteries 508 and 510 are mounted under a step of ladder 500. In an embodiment, the batteries 508 and 510 comprise lithium ion rechargeable batteries. In an embodiment, the batteries 508 and 510 are 24V batteries, although other configurations and voltages are possible. The battery 510 may be located under a step 514 of the ladder 500. The battery 508 may be located under a step 516 of the ladder 500. The ladder 500 may include a charger 506. The charger 506 may be located under a step 518 of the ladder 500.

In an embodiment, the ladder 500 may include a control box 504. The control box 504 may be mounted under a step of ladder 500. The control box 504 may be configured to control the motor hub wheels 502*a* and 502*b*. In an embodiment, ladder 500 may include a joystick 512, configured to communicate with the control box 504. The joystick 512 may communicate with the control box 504 via wire, or wirelessly.

Figure 6:
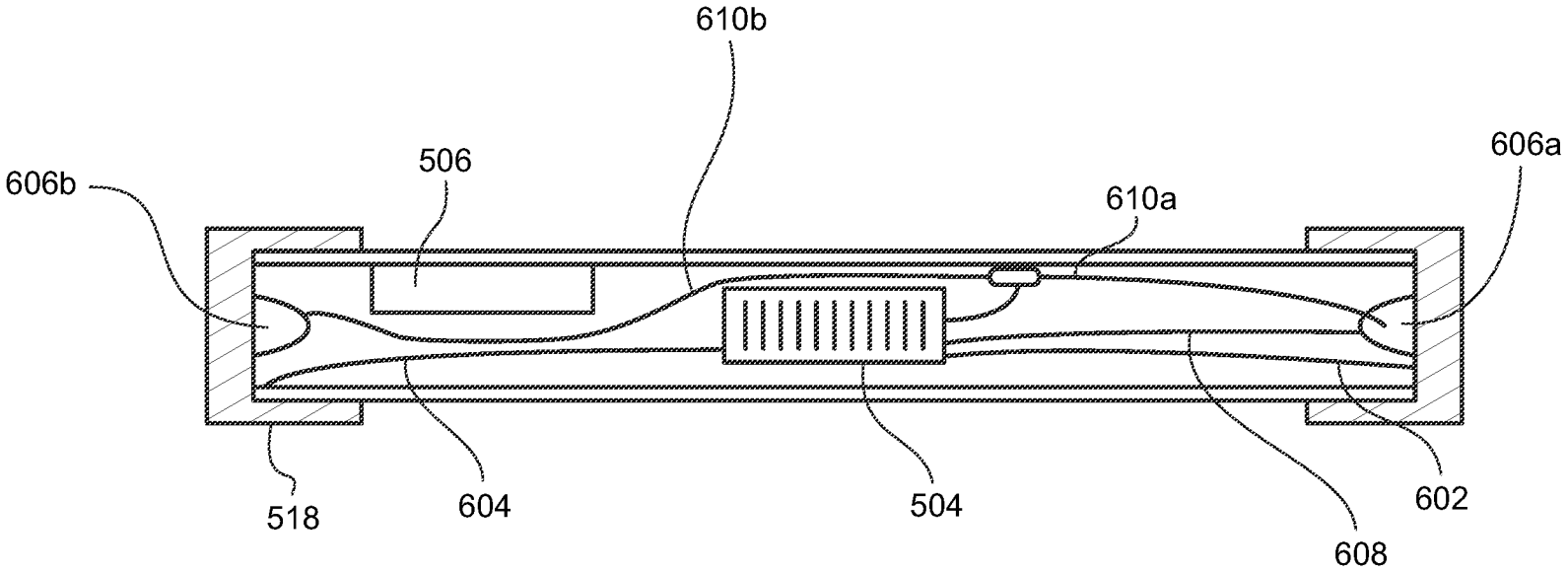
FIG. 6 is a schematic diagram illustrating a control box and a charger according to an embodiment herein.

FIG. 6, with reference to FIG. 5, is a schematic diagram illustrating the control box 504 and the charger 506 mounted under the step 518, according to an embodiment herein. A wire 602 may connect to the motor hub wheel 502*a*. A wire 604 may connect to the wheel 502*b*. The step 518 may include wire holes basses 606*a* and 606*b*. A wire 608 may connect to the joystick 512. Wires 610*a* and 610*b* may connect to the batteries 508 and 510.

Figure 7:
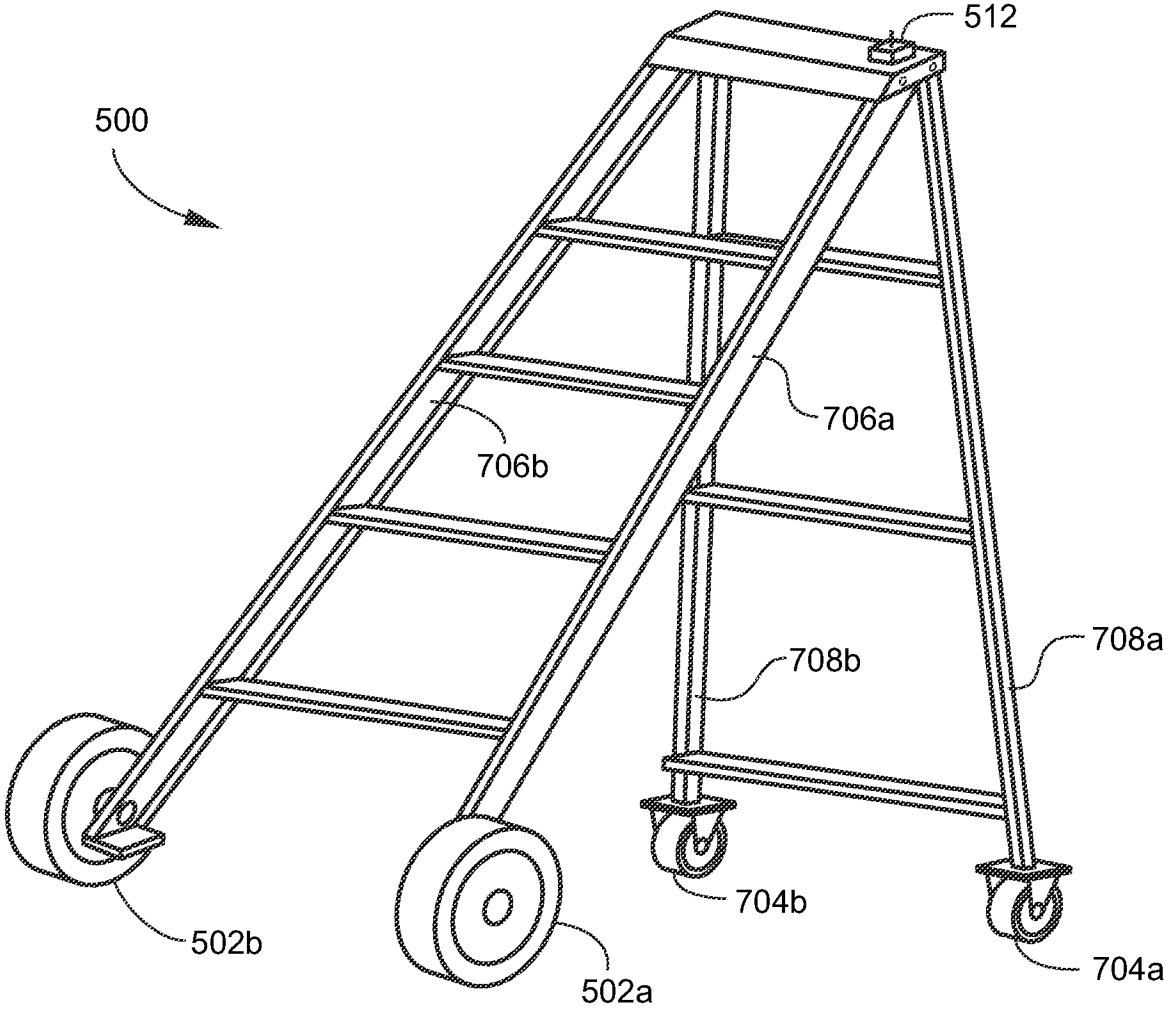
FIG. 7 is a schematic diagram illustrating a ladder according to another embodiment herein.

FIG. 7, with reference to FIGS. 5 and 6, is a schematic diagram illustrating the ladder 500. The ladder 500 may include front wheels 704*a*, 704*b*. In an embodiment, the joystick 512 is configured to wirelessly and remotely control the motor hub wheels 502*a* and 502*b*. The ladder 500 includes climbing legs 706*a*, 706*b*. The ladder 500 includes front legs 708*a* and 708*b*.

Figure 8:
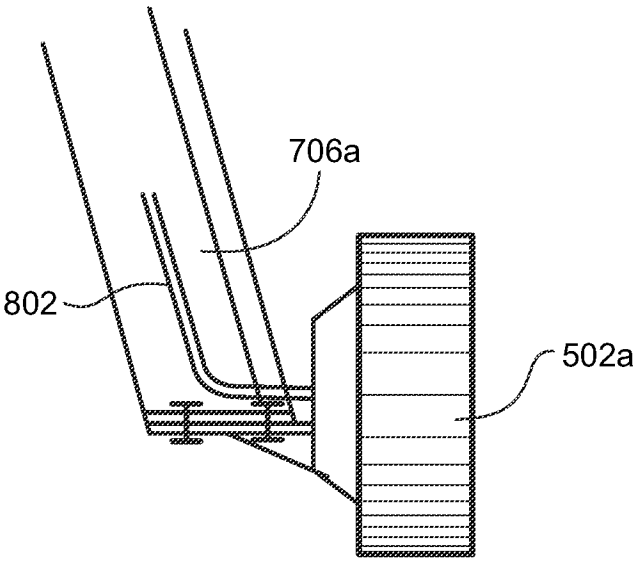
FIG. 8 is a schematic diagram illustrating ladder wheels according to an embodiment herein.
Figure 8:
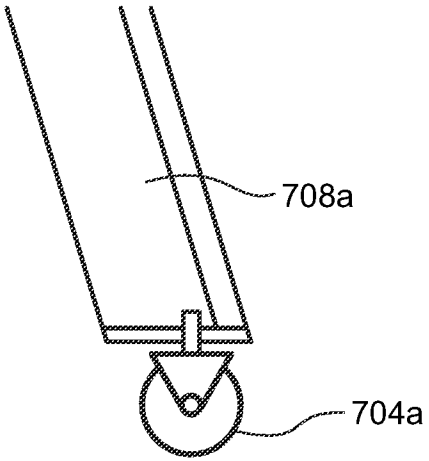

FIG. 8, with reference to FIGS. 5 through 7, is a schematic diagram illustrating the motor hub wheel 502*a* and the front wheel 704*a* according to an embodiment herein. The motor hub wheel 502*a* may be connected to the climbing leg 706*a*. The front wheel 704*a* may be connected to the front leg 708*a*. A wire 802 may connect the motor hub wheel 502*a* to the control box 504.

Figure 9:
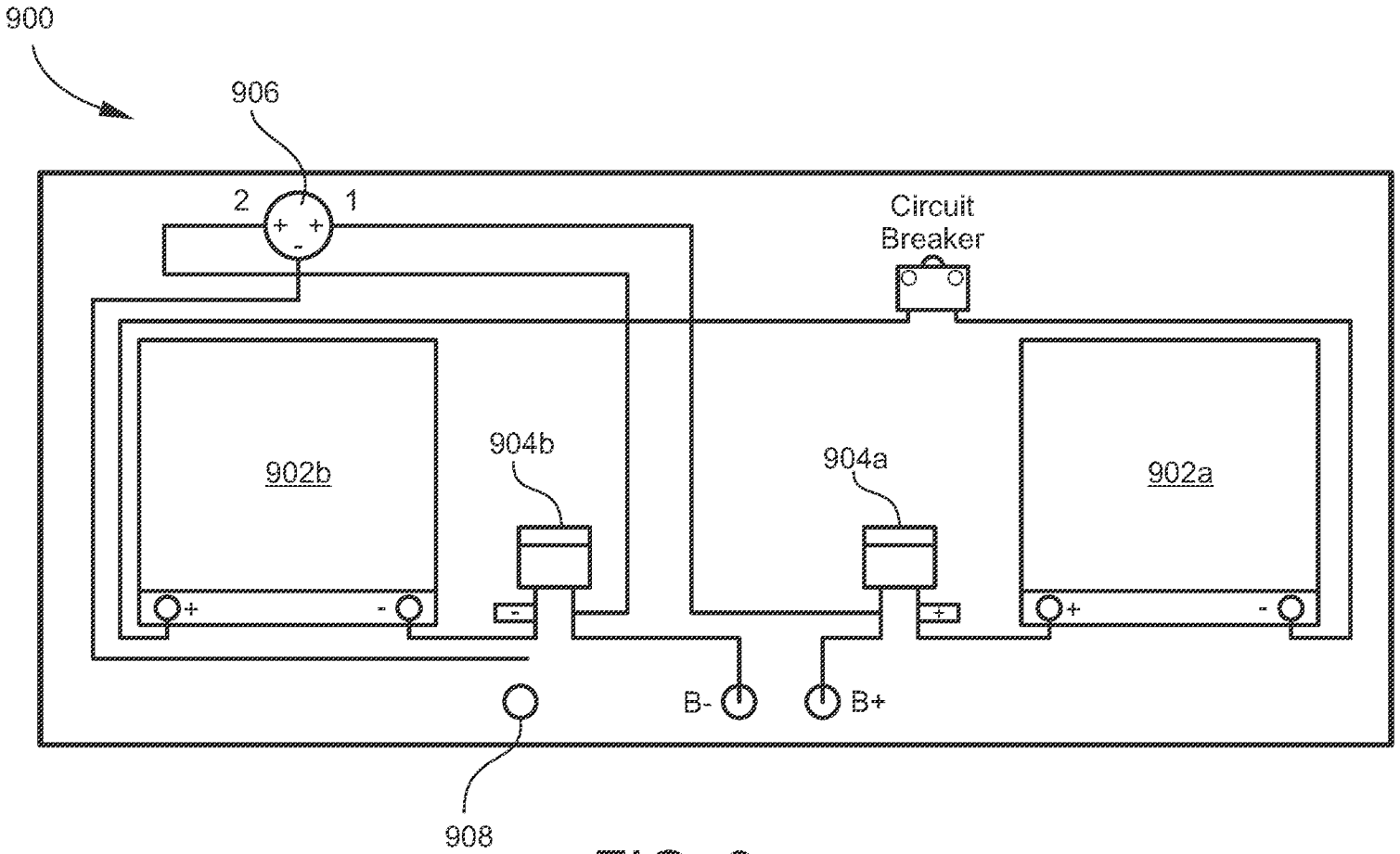
FIG. 9 is a schematic diagram illustrating battery connections according to an embodiment herein.

FIG. 9, with reference to FIGS. 1 through 8, is a schematic diagram illustrating battery connections system 900 according to an embodiment herein. In an embodiment, battery connections system 900 includes batteries 902*a* and 902*b*. In an embodiment, the batteries 902*a* and 902*b* are the batteries 402*a* and 402*b* illustrated in FIG. 4. In an embodiment, the batteries 902*a* and 902*b* are batteries 508 and 510 illustrated in FIG. 5. In an embodiment, battery connection system 900 includes fuse 904*a* and fuse 904*b*. In an embodiment, the fuses 904*a* and 904*b* are each a 50-Amp fuse, although other configurations are possible. In an embodiment, battery connection system 900 includes a charge plug 906 connected to the fuses 904*a* and 904*b* and an inhibit 908.

Figure 10:
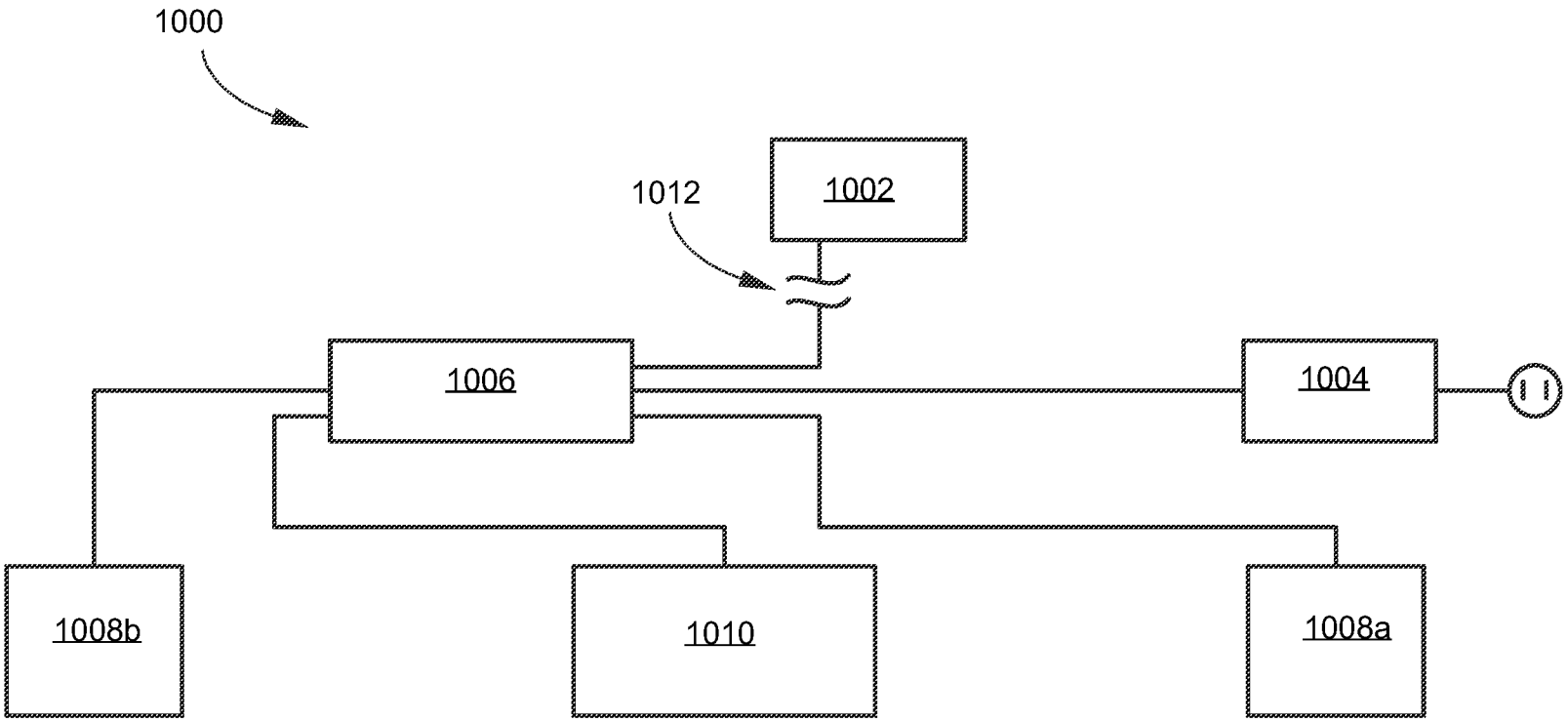
FIG. 10 is a schematic diagram illustrating a control system according to an embodiment herein.

FIG. 10, with reference to FIGS. 1 through 9, is a schematic diagram illustrating wiring system 1000. Wiring system 1000 may be used in the ladder 100 of FIG. 1 or in the ladder 500 of FIG. 5. A joystick 1002 may be connected to a controller 1006 via wired or wireless connection 1012. The controller 1006 may be connected to a charger 1004, a battery 1010, and motors 1008*a* and 1008*b*.

Figure 11:
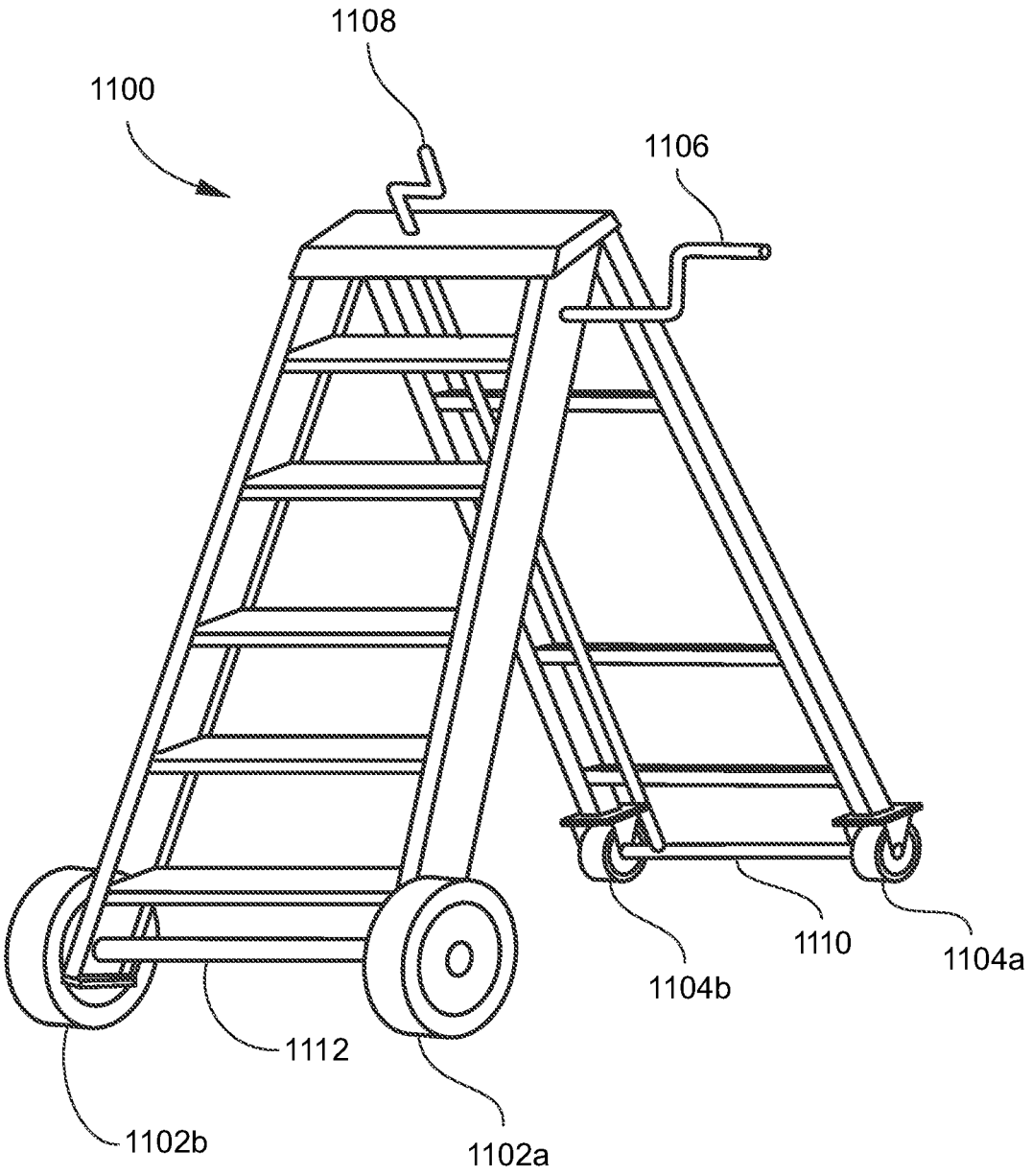
FIG. 11 is a schematic diagram illustrating a ladder according to another embodiment herein.

FIG. 11, with reference to FIGS. 1 through 10, is a schematic diagram illustrating a manual wheel ladder 1100 having a manual system for moving the ladder 1100. In an embodiment, the ladder 1100 includes a crank handle 1106 located on top of the ladder 1100 and a steering handle 1108 located on a side of the ladder 1100. The ladder 1100 may include front wheels 1104*a* and 1104*b*. The ladder 1100 may include wheels 1102*a* and 1102*b*. The ladder 1100 may include a front axle 1110 and a rear axle 1112.

Figure 12:
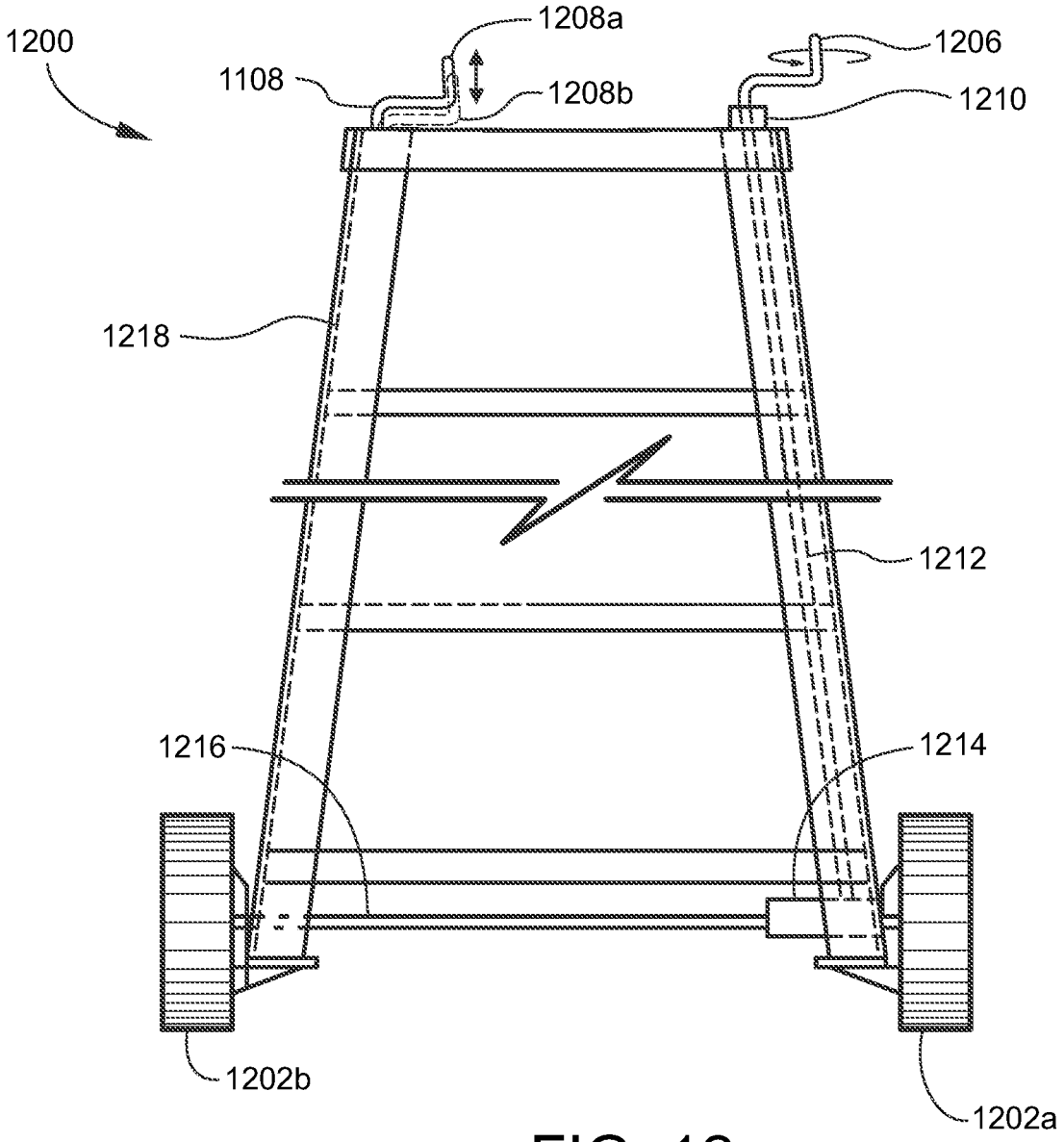
FIG. 12 is a schematic diagram illustrating a ladder according to another embodiment herein.

FIG. 12, with reference to FIG. 11, is a schematic diagram illustrating a front view of a manual wheel ladder 1200 according to an embodiment herein. In an embodiment, the steering handle 1108 has a steering position 1208*a* and a brake position 1208*b*. The steering handle 1108 may work as a brake if bushed down. In an embodiment, a crank handle 1206 is located on top of the ladder 1200. In an embodiment, moving the crank handle 1206 counterclockwise, moves the ladder 1200 forward and moving the crank handle 1206 clockwise, moves the ladder 1200 backward. In an embodiment, moving the crank handle 1206 clockwise, moves the ladder 1200 forward and moving the crank handle 1206 counterclockwise, moves the ladder 1200 backward. In an embodiment, the ladder 1200 includes a u-joint 1210. The ladder 1200 may include a driving shaft 1212. The ladder 1200 may include a steering shaft 1218. The ladder 1200 may include differential gearbox 1214 connected to an axle 1216. In an embodiment, the axle 1216 is a ⅝-inch axle, although other configurations and sizes are possible. In an embodiment, the ladder 1200 includes 10-inch wheels 1202*a* and 1202*b*, although other configurations and sizes are possible.

Figure 13:
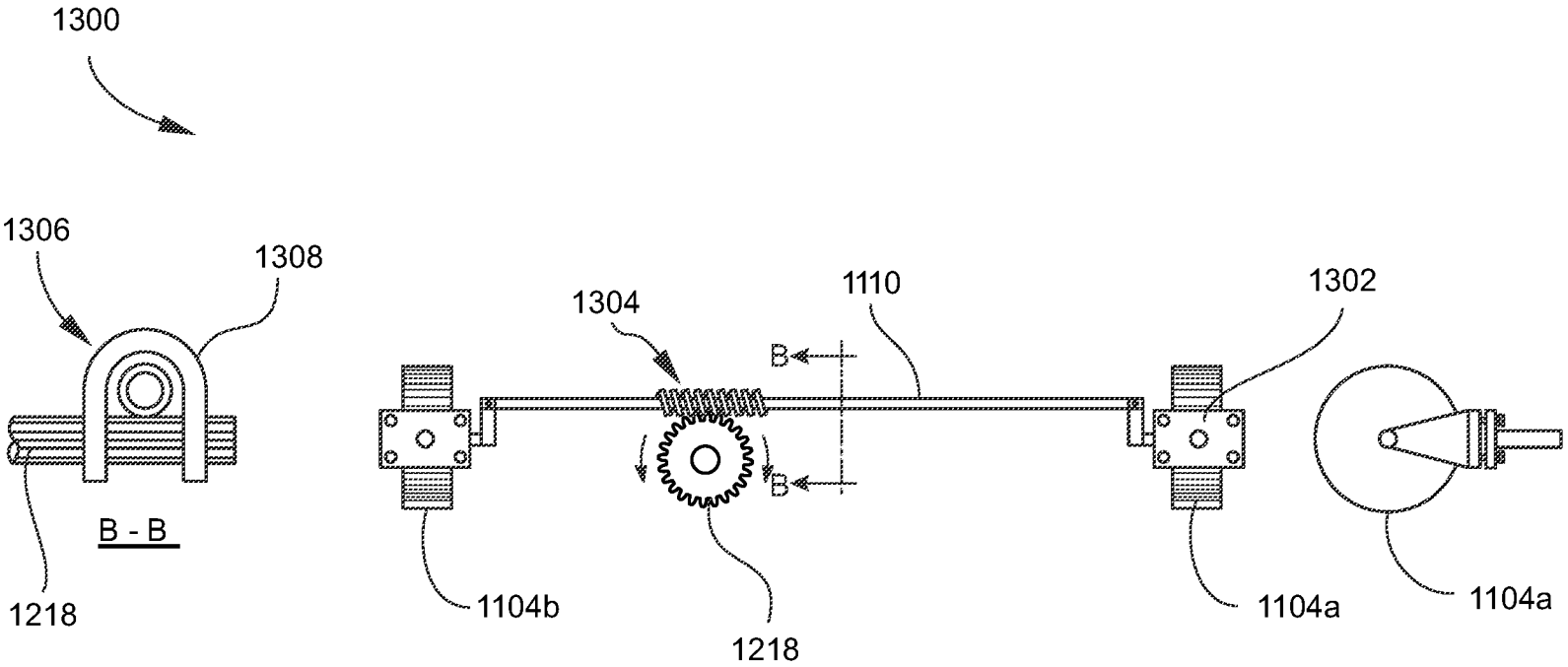
FIG. 13 is a schematic diagram illustrating a steering mechanism according to an embodiment herein.

FIG. 13, with reference to FIGS. 11 and 12, is a schematic diagram illustrating a steering and brake system 1300. In an embodiment, the steering shaft 1218 moves the front axle 1110 using gears 1304. In an embodiment, the shaft 1218, gears 1304, and axle 1110 transmit rotation of the handle 1108 to the wheels 1104*a* and 1104*b*. In an embodiment, wheels 1104*a* and 1104*b* are connected to the ladder 1200 using a plate 1302. In an embodiment, the steering and brake system 1300 includes braking mechanism 1306. Braking mechanism 1306 may include the shaft 1218, the axle 1110 and a climax 1308. In an embodiment, the axle 1110 is connected to the shaft 1218 using the climax 1306. In an embodiment, when the handle 1108 is in the brake position 1208*b*, the climax 1308 engages the axle 1110 in order to lock and prevent its movement, hence functioning as a brake for the wheels 1104*a* and 1104*b*.

Figure 14:
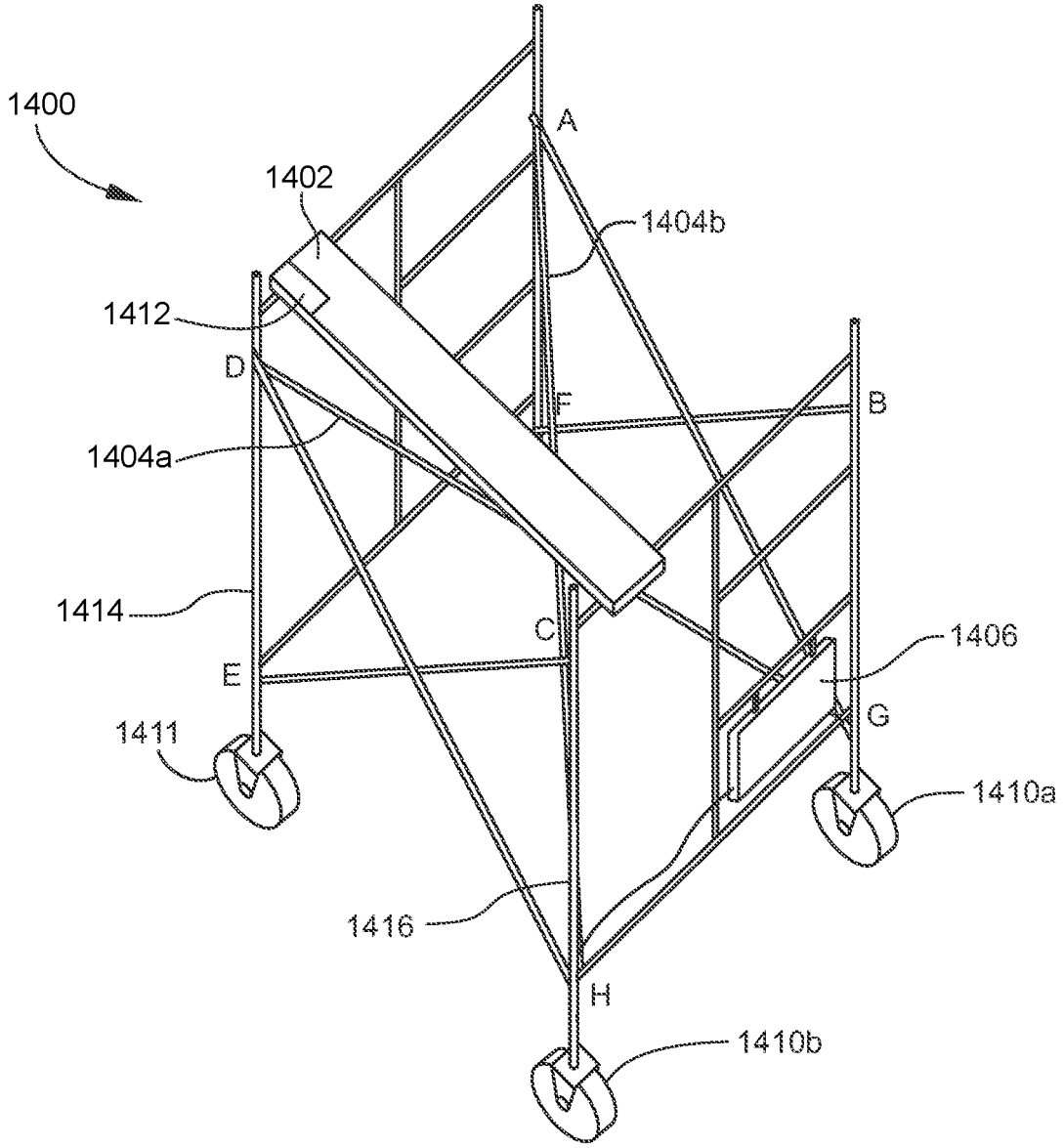
FIG. 14 is a schematic diagram illustrating a scaffold according to an embodiment herein.

FIG. 14 is a schematic diagram illustrating a scaffold 1400 according to another embodiment herein. In an embodiment, the scaffold 1400 includes a platform or board 1402, and a plurality of bars including adjustable tie bars 1404*a*, 1404*b* (collectively referred to as tie bar 1404). The various connections points (labeled A through H in FIG. 14) represent connection points for various bars in the scaffold 1400. In an embodiment, the board 1402 is used by a worker to stand upon or for the placing of equipment thereupon. In an embodiment, a motor box 1406 is connected to the scaffold 1400. The motor box 1406 may be connected to wheels 1410*a*, 1410*b* of the scaffold 1400 and may be configured to rotate the wheels 1410*a*, 1410*b* for moving the scaffold 1400. Wheels 1410*a*, 1410*b* may be the motorized wheels and wheels 1411 may be non-motorized, in one embodiment (note in FIG. 14, only one wheel 1411 is shown due to the angle of the view; however the scaffold 1400 contains a pair of wheels 1411 configured on opposite ends (e.g., one at position E and one at position F). The motor box 1406 may be controlled using a joystick 1412, which may be configured on the board 1402. In an embodiment, the joystick 1412 is connected to the motor box 1406 using a wire 1408. In an embodiment, the joystick 1412 is connected to the motor box 1406 wirelessly.

Figure 15:
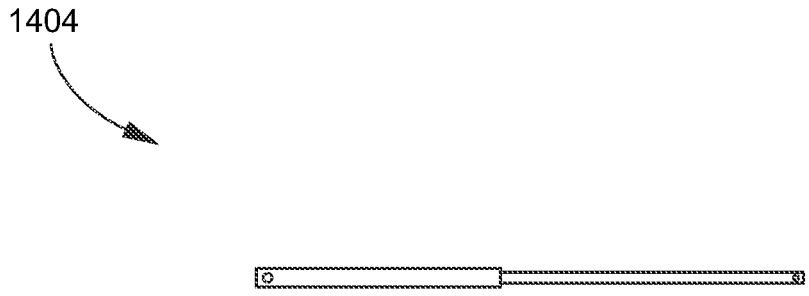
FIG. 15 is a schematic diagram illustrating a bar according to an embodiment herein.

FIG. 15, with reference to FIG. 14, is a schematic diagram illustrating the adjustable tie bar 1404 (e.g., tie bars 1404*a*, 1404*b* of FIG. 14), according to an embodiment herein. In an embodiment, the adjustable tie bar 1404 is configured to safely hold bars 1414, 1416 of the scaffold 1400. In an embodiment, the length of the adjustable tie bar 1404 may be adjusted to securely hold the bars 1414, 1416 at appropriate widths.

Figure 16:
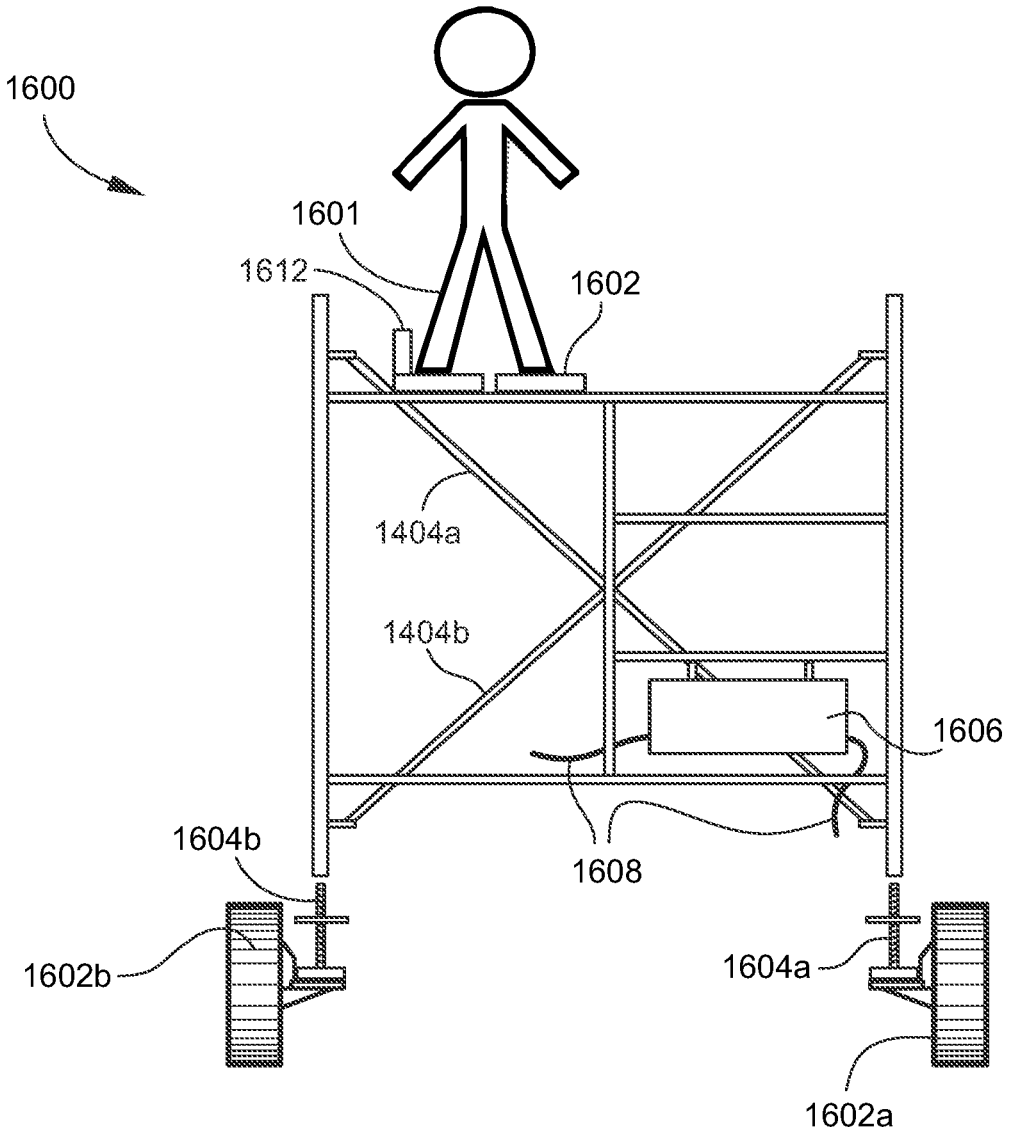
FIG. 16 is a schematic diagram illustrating another scaffold according to an embodiment herein.

FIG. 16, with reference to FIGS. 14 and 15, is a front view of a scaffold 1600 according to an embodiment herein. In an embodiment, the scaffold 1600 includes boards 1602 to accommodate a user/worker 1601. The scaffold 1600 further includes motor hub wheels 1602*a*, 1602*b*. The motor hub wheels 1602*a*, 1602*b* may be configured to lock-in the adjustable jacks 1604*a*, 1604*b*. In an embodiment, the jacks 1604*a*, 1604*b* are configured to level the scaffold 1600. The jacks 1604*a*, 1604*b* can be adjusted manually or automatically by the joystick 1612 to make the scaffold 1600 level while it is moving. The motor hub wheels 1602*a*, 1602*b* may be connected to a battery/control box 1606. In an embodiment, the battery/control box 1606 is configured to control movements of the motor hub wheels 1602*a*, 1602*b* using wires 1608. In an embodiment, the wheels 1602*a*, 1602*b* have a diameter greater than approximately twelve inches, although other sizes and configurations are possible in accordance with the embodiments herein. Unlike conventional approaches where workers need to surround the entire building or structure with scaffolding, the moving scaffolds 1400, 1600 of FIGS. 14 through 16 allow the workers to use one scaffold and be able to move around a building or structure.

The ladders 100, 500, 1100, 1200, and the scaffolds 1400, 1600 may be used at any location including, but not limited to, a construction site, a warehouse, a library, home, business, and a store. The ladders 100, 500, 1100, 1200, and the scaffolds 1400, 1600 may also be used by filmmakers by placing camera equipment or the cameraman on the ladder or scaffold. The embodiments disclosed herein may be used to save production time.

All dimensions mentioned herein are only exemplary and for illustration purposes. It is obvious to a person with ordinary skill in the art that other dimensions may be used based on any specific application of the embodiments herein. The embodiments herein may be used in connection with other tools, accessories, and parts used, for example, in a construction site.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

What is claimed is:

1. A moving ladder system comprising:

a ladder;

a first set of legs of the ladder comprising a plurality of steps;

a second set of legs of the ladder;

a first set of wheels attached to said first set of legs;

a second set of wheels attached to said second set of legs;

a single control box mounted within a first step of the plurality of steps, wherein said single control box is configured to control rotation of said first set of wheels;

an electric charger adjacent to said single control box and mounted within the first step of the plurality of steps; and a battery mounted within a second step of the plurality of steps, wherein the second step is above the first step, wherein said second set of wheels are free wheels and are not directly connected to said single control box, and wherein said first set of wheels are motor hub wheels.

2. The ladder system of claim 1, wherein said control box is electrically connected to said first set of wheels.

3. The ladder system of claim 1, wherein said first set of wheels and said second set of wheels are configured to disconnect from said first set of legs and said second set of legs respectively.

4. The ladder system of claim 1, further comprising a steering mechanism attached to a top of the ladder and configured to steer said second set of wheels, and wherein said steering mechanism comprises a joystick configured to send steering signals to said control box.

5. The ladder system of claim 4, wherein said joystick sends said steering signals to said control box wirelessly.

6. A moveable climbing system comprising:

a first set of legs comprising at least a first step, a second step, and a third step;

a second set of legs;

a first battery mounted within said second step of said first set of legs, wherein said second step is above said first step;

a second battery mounted within said third step of said first set of legs, wherein said third step is above said second step;

a first set of motorized wheels attached to said first set of legs;

a second set of free wheels attached to said second set of legs; and a single control box mounted within the first step, wherein said single control box is configured to control rotation of said first set of motorized wheels;

motors, each one of said motors being operatively connected to a respective one of said first set of motorized wheels and said each one of said motors being configured to electrically rotate said respective one of said first set of motorized wheels, wherein said motors are not directly connected to said second set of free wheels, and wherein said first step of said first set of legs is positioned entirely above a top of said first set of motorized wheels and said second set of free wheels.

7. The climbing system of claim 6, wherein any of said first battery and said second battery provide electric supply for said motors.

8. The climbing system of claim 6, wherein each of said first step, said second step, and said third step comprises a rung of a ladder.

* * * * *